United States Patent [19]

Lew et al.

[11] Patent Number: 4,591,021

[45] Date of Patent: May 27, 1986

[54] SKY-SLIDE EMERGENCY ESCAPE SYSTEM

[76] Inventors: Hyok S. Lew, 7890 Oak St., Arvada, Colo. 80005; Mike Stranahan, 2858 Woody Creek Rd., Woody Creek, Colo. 81656

[21] Appl. No.: 647,364

[22] Filed: Sep. 4, 1984

Related U.S. Application Data

[63] Continuation-in-part of Ser. No. 562,839, Dec. 19, 1983.

[51] Int. Cl.[4] ..... A62B 1/00

[52] U.S. Cl. ..... 182/10; 182/191; 242/107

[58] Field of Search ..... 182/3–8, 182/10, 11, 189, 191, 192; 188/65.1, 65.2; 242/107

[56] References Cited

U.S. PATENT DOCUMENTS

| | | | |
|---|---|---|---|
| 44,934 | 11/1864 | Chandler | 182/191 |
| 283,159 | 8/1883 | Woodward | 182/3 |
| 293,177 | 2/1884 | Joyce | 182/10 |
| 295,929 | 4/1884 | MacDonough | 182/10 |
| 346,406 | 7/1886 | Hutchings | 182/10 |
| 1,587,427 | 6/1926 | Schwier | 242/107 |
| 1,824,279 | 9/1931 | Koleska | 182/5 |

FOREIGN PATENT DOCUMENTS

| | | | |
|---|---|---|---|
| 5882 | of 1911 | United Kingdom | 182/3 |

*Primary Examiner*—Reinaldo P. Machado

[57] ABSTRACT

This invention relates to a rapid emergency escape system from an elevated structure which could be used as a fire-escape system from different levels of high rise building to its ground level. The sky-slide emergency escape system of the present invention includes a guide wire rope branching to at least two braking wire ropes wherein the upper end of the guide wire rope is secured to an elevated structure and each of the branching wire ropes reaching down to the ground level is reeled on each of a plurality of take-up reels equipped with a braking means for releasing the branching wire ropes under a preset tension and a means for rewinding the branching wire ropes on the reels. These take-up reels with braking means and rewinding means are widely separated from each other and immovably secured at the ground level. The person escaping from the elevated structure to the ground level wears a harness secured around one's torse and limbs which includes a sturdy tether with a strong clasp attached to the free end thereof. Upon hooking said clasp onto the guide wire rope depending from the elevated structure and branching to at least two braking wire ropes, which combination of wire ropes is tautly disposed into the shape of a pyramid because of the tension on the wire ropes generated by the reeling action of the take-up reels, the person wearing the harness jumps down, descends at a high speed following the guide wire rope, slows down as the braking action provided by the branching wire ropes takes place, and lands safely. As soon as the escaped person unhooks the clasp attached to the harness from the branching wire ropes, the take-up reels reel up the branching wire ropes automatically and puts the guide wire and the braking wires again in a taut condition readying itself for next descending person.

21 Claims, 9 Drawing Figures

SKY-SLIDE EMERGENCY ESCAPE SYSTEM

This patent application is a Continuation-In-Part application to a patent application Ser. No. 562,839 entitled "Sky-Slide System from Elevated Structures", which was filed on Dec. 19, 1983.

BACKGROUND OF THE INVENTION

The hazards to human lives in case of fires in high rise apartments, hotels and office buildings is amply demonstrated by the recurring tragedies involving the loss of lives and property in many densely populated cities with many high rise buildings. Often, the occupants of high rise buildings are cut off from the escape route to the ground level as well as to the top of the building by fire and smoke erupting through the stairwells and elevator shafts. At the present time, the only way to rescue people from a burning skyscraper is either by a helicopter or by a fire truck ladder. The former method is limited to rescuring people from the top of a skyscraper, while the latter method is limited to evacuating people from the lower levels of the skyscraper. The simple truth is that there is no means available today for rescuing people trapped in the middle of a burning skyscraper. The methods of using helicopters and fire truck ladders are far from being satisfactory answer, because those method are slow, inefficient and hazardous.

SUMMARY

The primary object of the present invention is to provide a rapid emergency escape system from an elevated structure that can be used to escape from any level of the elevated structure.

Another object of the present invention is to provide a simple, fast and inexpensive emergency escape system from any level of an elevated structure wherein its operation is reliable, inexpensive and reusable.

A further object of the present invention is to provide an emergency escape system from any level of an elevated structure that is mostly self-contained and that becomes operative with the minimum amount of assistance from equipment stationed at the ground level.

Still another object of the present invention is to provide an emergency escape system from any level of an elevated structure that can be tucked away and stored in such a way that the daily use of the elevated structure is not hindered at all by the existence of the escape system.

Still a further object of the present invention is to provide an emergency escape system from elevated structures that can be used by average people including children, women and men of average mental and physical capability.

These and other objects of the present invention will become obvious as the description thereof proceeds.

BRIEF DESCRIPTION OF FIGURES

The present invention and its objects may be described with greater clarity and specificity by referring to the following Figures.

DESCRIPTION OF THE PREFERRED EMBODIMENTS

Figure 1:
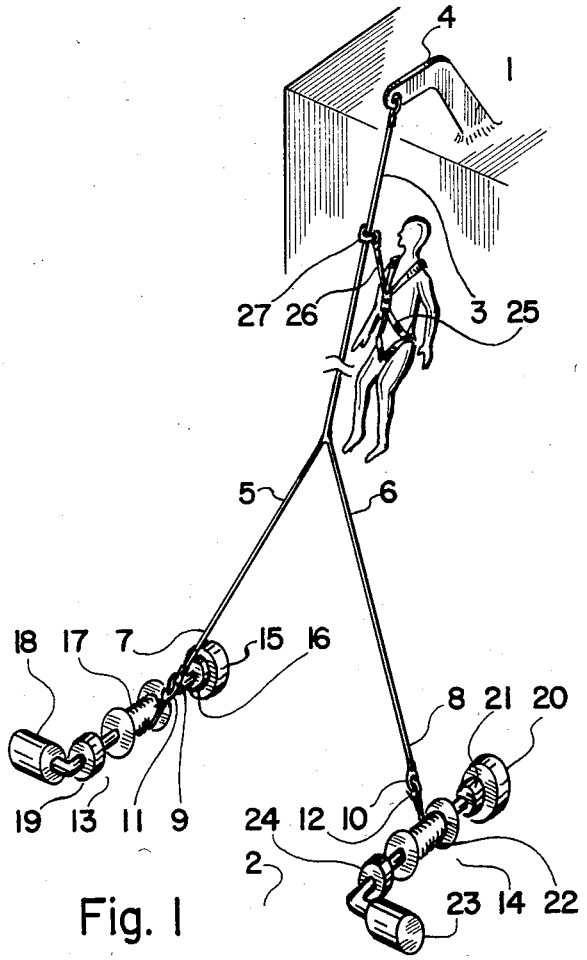
FIG. 1 illustrates a perspective view of an embodiment of the sky-slide emergency rescue system showing an initial phase of an escape operation.

In FIG. 1 there is shown a perspective view of an embodiment of the sky-slide emergency escape system, which demonstrates the principles of the present invention teaching a rapid escape system from an elevated structure. The sky-slide emergency escape system for rapidly evacuating a person or an object from an upper level 1 to a lower level 2 comprises a guide wire rope or guide cord 3 depending from an over-hanging structure 4 secured at the upper level 1 and a pair of braking wire ropes or braking cords 5 and 6 extending from one extremity of the guide wire 3. The other extremity of the guide wire 3 is secured to the over-hanging structure 4 anchored to the upper level 1. The extremities 7 and 8 of the braking wire ropes 5 and 6 reaching down the lower level 2 include the connecting means 9 and 10, respectively, and are connected to the take-up wire ropes or take-up cords 11 and 12, respectively. The take-up wire ropes 11 and 12 are reeled up on the take-up reel systems 13 and 14, respectively. The take-up reel systems 13 and 14 are widely separated from each other and are immovably secured to the lower level 2 in either a permanent or a temporary manner. The take-up reel system 14 includes a one-way braking means comprising a mechanical or a hydraulic or a electro-magnetic brake 15 and a ratchet coupling 16 coupling the brake 15 to the reeling drum 17. The one-way braking means does not hinder the reeling rotation of the reeling drum 17, while it hinders the unreeling rotation of the reeling drum and thus maintains a tension of a preset level on the braking wire rope 5 for all instances during the unreeling phase. The take-up reel system 13 further includes a power drive 18 coupled to the reeling drum 17 by the friction clutch 19. The friction level in the friction clutch 19 is set at a level high enough to reel up the take-up wire ropes 11 on the reeling drum 17 when the braking wire rope 5 connected to the take-up wire rope 11 is free from any restraint other than its own weight and its own stiffness, while its friction level is low enough to allow the reeling drum 17 to slip and unreel the take-up wire rope 11 when the braking wire rope 5 connected thereto is pulled by a large tension such as the one created by a person descending on the sky-slide emergency escape system. The take-up reel system 14 includes a one-way braking means comprising a brake 20 and a ratchet coupling 21, a reeling drum 22, a power drive 23 and a friction clutch 24, which elements have the same objectives and functions as those included in the take-up reel system 13.

When an emergency arises requiring the evacuation of people from the upper level 1 to the lower level 2 by means of the sky-slide system shown in FIG. 1, the person escaping from the upper level 1 to lower level 2 puts on a harness 25 securing the torso and limbs, which harnesses are stored on the upper level 1 in suitable quantities. The harness 25 includes a sturdy tether 26 and a strong clasp 27 attached to the free end thereof. The escaping person wearing the harness 25 hooks on the clasp 27 onto the guide wire rope 3 and jumps off, whereupon the escaping person free-falls following the guide wire 3 until the clasp 27 reaches the branching point of the braking wire ropes 5 and 6 and starts pulling the braking wire ropes 5 and 6 together. The pulling action of the braking wire ropes 5 and 6 generated by the descending clasp 27 simultaneously engaged by the braking wire ropes 5 and 6 creates a high tension on the braking wire ropes 5 and 6 and, consequently, on the take-up wire ropes 11 and 12 which become unreeled from the take-up reel systems 13 and 14 in a controlled rate as dictated by the one-way braking included therein. The deceleration of the descending speed of the escaping person can be analized quantitatively in two different concepts. The net resultant force on the clasp 27 resulting from the tensions on the braking wire ropes 5 and 6 is in the upward vertical direction. It can be easily shown that the deceleration of the person decsending on the sky-slide system shown in FIG. 1 is approximately given by the equation $$a = -\left(\frac{2T}{m} - g\right) + \frac{2T}{m}\sin\theta,$$

wherein a is the acceleration, T is the tension on the braking wire ropes 5 and 6 created by the one-way braking means included in the take-up reel systems 13 and 14; m is the mass of the descending person; g is the earth's gravitational acceleration and $\theta$ is the angle between a braking wire rope and the horizontal plane. In this formula the effect of the friction between the clasp 27 and the braking wire ropes is not included. It is not difficult to recognize from this formula that, when the tension on the braking wire rope is maintained at a value equal to three times that of the weight of the descending person, the descending movement starts to decelerate when $\theta$ becomes equal to 56 degrees and the maximum rate of deceleration is equal to 5 g at the time of landing on the lower level 2. It is obvious that the difference in the potential energy between the upper level 1 and the lower level 2 has to be counter-balanced by the work done by two braking ropes during the unreeling phase, if the descending person is to be safe-landed on the lower level 2. This condition may be written in an equation $$\int_{L_1}^{L_2} T\,dl = \frac{wh}{2},$$

where $L_1$ and $L_2$ are the initial and final length of the unreeled portion of the take-up wire rope connected to the braking wire rope; T is the tension on the take-up wire rope created by the one-way braking means included in the take-up reel system; d1 is the differential length of the take-up wire rope; w is the weight of the descending person, h is the height from the lower level 2 to the upper level 1. If the tension on the take-up wire rope remains constant during the unreeling phase of descending, the aforementioned equation becomes $$T\Delta L = (wh)/2,$$

where $\Delta L$ is the length of the take-up wire rope unreeled during the descending motion of the escapee. It can be easily discovered from this equation that, when the tension on the braking wire ropes is maintained at a value equal to three times that of the weight of the descending person, the sky-slide system can safely bring down a person from a height equal to six times the length of each take-up wire rope unreeled from each take-up reel system. For example, a sky-slide system including a pair of the take-up reel systems wherein each take-up reel system unreel 100 ft. of take-up wire rope while maintaining 600 pounds of tension, can safely bring down a person weighing 200 pounds from a height of 600 ft. When a sky-slide system is equipped with four braking wire ropes connected to four different take-up reel systems, it takes only 50 ft. length of unreeling wire to rescue a person from a 600 ft. height. This estimation clearly shows the feasibility and practicality of the sky-slide system in many applications including the rapid fire escape system from high-rise buildings. Once the descending person lands safely on the lower level 2, the clasp 27 is unhooked from both braking wire ropes 5 and 6. Now there is no major restraint on the take-up wire ropes 11 and 12, the friction clutch 19 and 24 activates the reeling rotation of the reeling drums 17 and 22, respectively, and the braking wire ropes 5 and 6 are put back in a taut state and in the shape of a pyramid. It is then ready to lower another person.

It should be understood that, the power drives 18 and 23 driving the reeling drums 17 and 22 are in operation for all instances during the rescue operation and, consequently, everything is automatic in the operation of the sky-slide system shown in FIG. 1 with the exception of the hooking and unhooking of the clasp 27 onto and off of the wire ropes by the descending person. It should be understood that the take-up reel systems 13 and 14 may be permanently installed units in conjunction with the construction of the elevated structure including the upper level 1 or they may be mobile units mounted on fire trucks and other types of emergency and rescue vehicle. It should be also understood that the take-up reel systems 13 and 14 may be completely automatic as described in conjunction with FIG. 1 or be semiautomatic or manual operations type using manual controls that activates the power drive-deactivates the brake and vice versa wherein the friction clutch and the ratchet couplings are not required. Even in the fully automated take-up reel systems, there are other means that serves the same purpose as the ratchet coupling and the friction clutch. The specific embodiment of the take-up reel system described in conjunction with FIG. 1 is an example of many take-up reel systems of fully automatic or semiautomatic operation which are available to create the controlled release of the take-up wire rope from the take-up reel system under braking. It must be mentioned that the guide wire rope may branch to less or more than two braking wire ropes depending on the specific working environment and operating conditions. It should be mentioned that the sky-slide system works well without the guide wire ropes. For example, the pair of braking wire ropes 5 and 6 can be directly secured to the over-hanging structure 4 and the sky-slide system functions perfectly well as long as the escaping person hooks the clasp 27 around both braking wire ropes 5 and 6. The guide wire rope is included in the embodiment shown in this patent application, because it eliminates the potential cause of fatal accidents created by a descending person inadvertantly hooking the clasp 27 on one braking wire rope only when two or more braking wire ropes are directly secured to the over-hanging structure 4. The inclusion of the guide wire rope 3 also enables one to bring down the evacuees at an accelerated pace.

Figure 2:
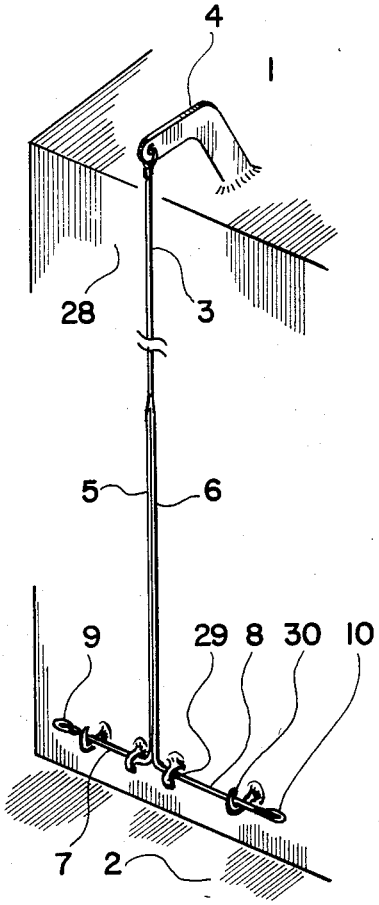
FIG. 2 illustrates a perspective view of the sky-slide emergency escape system of FIG. 1 in a stowed away arrangement for storage.

In FIG. 2 there is shown a perspective view of the sky-slide system shown in FIG. 1 minus the take-up reel systems 13 and 14, which shows the sky-slide system of FIG. 1 stowed away in a storage position after it is disconnected from the mobile take-up reel systems. The combination comprising the guide wire rope 3 and the braking wire ropes 5 and 6 branching and extending therefrom is disposed adjacent to the wall 28 of the elevated structure and the lower extremities 7 and 8 of the braking wire ropes 5 and 6 are held down by a hold-down means comprising pluralities of holding hooks 29, 30, etc. When an emergency arises requiring the evacuation of people from the upper level 1 to the lower level 2, a pair of fire trucks equipped with the take-up reel system such as the unit 13 or 14 shown in FIG. 1 and responding to the emergency are parked at two locations on the lower level 2 some distance away from the wall 28 of the elevated structure and separated from one another at a predetermined distance and an equal distance away from the vertical plane including the guide wire rope 3. when the rescue crew connects the lower extremity of each of the braking wire ropes to each of the take-up reel systems mounted on the fire trucks and turns on the power driving the take-up reel systems, the braking wire ropes 5 and 6 become stretched into the shape of a pyramid and the sky-slide system is ready for use. It is not difficult to imagine that the wire ropes included in the sky-slide system may be pulled up to the upper level 1 and reeled on a storage reel there. In case of emergency, the people at the level 1 have to unreel and lower the wire ropes to the level 2. It should be understood that the guide wire rope with a plurality of the braking wire ropes extending therefrom can originate and depend from any level of the elevated structure, as they function in the same way no mater what level they originate from once they are connected to the take-up reel systems. The take-up reel systems may be mounted on the fire trucks or other rescue vehicles, as described in conjunction with FIG. 2. The take-up reel systems may be installed permanently under the street or parking lot adjacent to the elevated structure. In such a permanent installation, only the connecting ends of the take-up wire ropes must be located in a releasable manner at the appropriate locations in relation to a vertical plane including the guide wire, while the actual reeling and braking assemblies can be located any place wherein the take-up wire ropes are routed through under ground tunnels.

Figure 3:
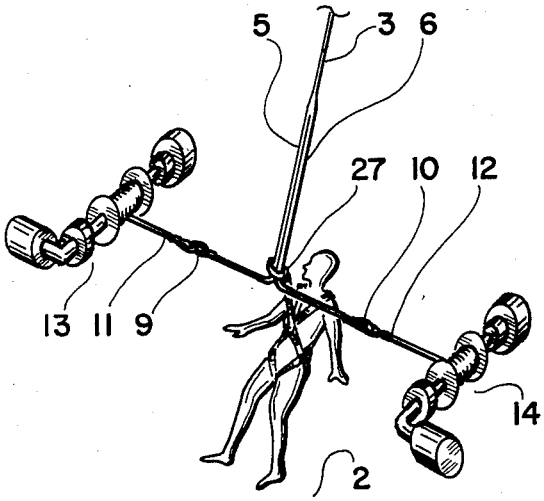
FIG. 3 illustrates a perspective view of the sky-slide emergency escape system of FIG. 1 showing a final phase of an escape operation.

In FIG. 3 there is shown the lower half of the sky-slide emergency escape system of FIG. 1 at an instant when an evacuee is about to touch down on the level 2. It is clear that the take-up reel systems have to reel and release the take-up wire ropes 11 and 12, because the clasp 27 pulled down by the descending person has changed the configuration of the braking wire ropes 5 and 6 from a shorter configuration as shown in FIG. 1 to a longer configuration as shown in FIG. 2. As soon as the clasp 27 is removed from the braking wire ropes 5 and 6, the take-up reel systems 13 and 14 reel up the braking wire ropes and put them back into a shorter configuration as shown in FIG. 1 and the sky-slide system is ready for another descending. It is important for smooth operation of the sky-slide system that the splicing of the guide wire rope 3 and the braking wire ropes 5 and 6 is free of any knots. One of the best methods to construct the branching wire ropes used in the sky-slide system is to run each of the braking wire ropes all the way to the securing end of the guide wire rope and then to enclose them together tightly within a tubing over the length from the securing end to the branching point.

Figure 4:
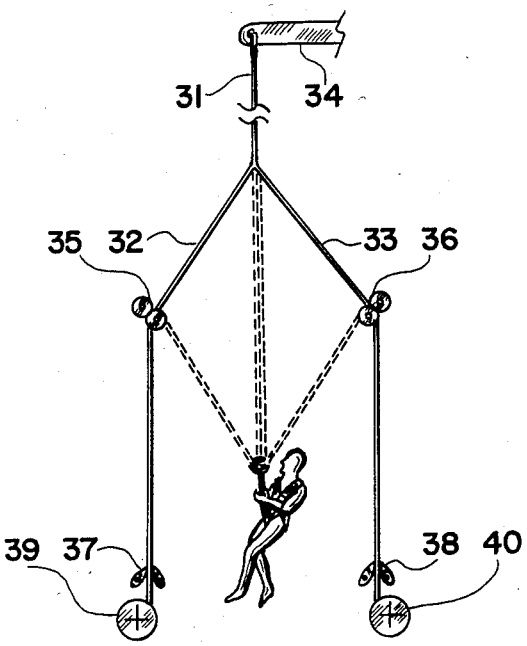
FIG. 4 illustrates another embodiment of the sky-slide emergency escape system.

In FIG. 4 there is illustrated another embodiment of the sky-slide emergency escape system constructed in accordance with the principles of the present invention. The combination of the guide wire rope 31 and the pair of the braking wire ropes 32 and 33 branching and extending therefrom is depending from an over-hanging structure 34 secured at an elevated level. The braking wire ropes 32 and 33 reach down to the lower level after slidably engaging and extending through the wire rope guides 35 and 36 comprising a plurality of guide sheaves, respectively. The wire rope guides 35 and 36 are disposed at two opposite sides of and at equal distances away from a vertical plane including the guide wire rope 31. The braking wire ropes 32 and 33 are routed through the check stops 37 and 38, respectively, and are connected to the take-up wire ropes reeled on the take-up reel systems 39 and 40 installed on the lower level, respectively. When the check stops 37 and 38 are activated manually, the check stops 37 and 34 allows the braking wire ropes 32 and 33 to be unreeled from the take-up reel systems 39 and 40, while they prevent the braking wire rope 32 and 33 from being reeled up onto take-up reel systems 39 and 40. When the check stops 37 and 38 are deactivated manually, they do not interfere with the reeling and unreeling movement of the braking wire ropes 32 and 33. The take-up reel systems 39 and 40 may comprise the same elements as the units 13 and 14 described in conjunction with FIG. 1 or they may respectively comprise a take-up drum driven by a power drive via a high friction clutch playing a dual role; a brake for controlling the unreeling motion of the braking wire rope and a drive clutch for reeling of the braking wire rope on the take-up drum. The need of the one-way braking means for the take-up reel systems is eliminated because of the inclusion of the check stops 37 and 38. The braking wire ropes shown in the broken lines illustrates the configuration of the braking wire ropes 32 and 33 at an instant when an evacuee is about to land on the lower level. The embodiment of the braking wire ropes shown in FIG. 4 is capable of more rapidly slowing down the descending motion of the evacuee compared with the embodiment shown in FIG. 1.

Figure 5:
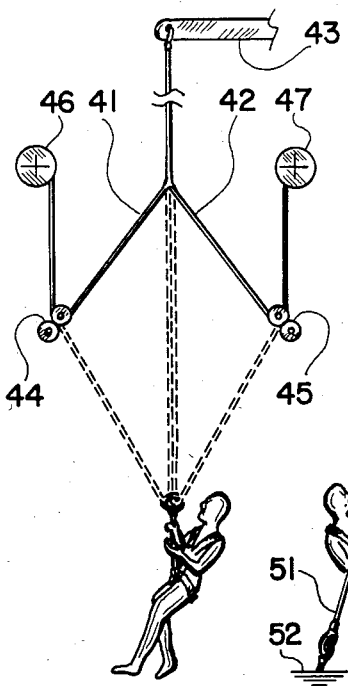
FIG. 5 illustrates a further embodiment of the sky-slide emergency escape system.

In FIG. 5 there is shown a further embodiment of the sky-slide emergency escape system comprising a guide wire rope with a pair of the braking wire ropes 41 and 42 depending from an over-hanging structure 43 secured to the upper level and a pair of the wire rope guides 44 and 45. These elements are disposed essentially the same way as those included in FIG. 4 and have the same functions as those included in FIG. 4. The pair of the take-up reel systems 46 and 47 are installed at a level above the lower level that may be intermediate the upper level and the lower level or equal to or even higher than the upper level from which the evacuees are descending to the lower level. The take-up reel systems 46 and 47 must comprise all elements included in those units 13 and 14 described in conjunction with FIG. 1 in view that the embodiment shown in FIG. 5 does not include the wire rope check stops.

Figure 6:
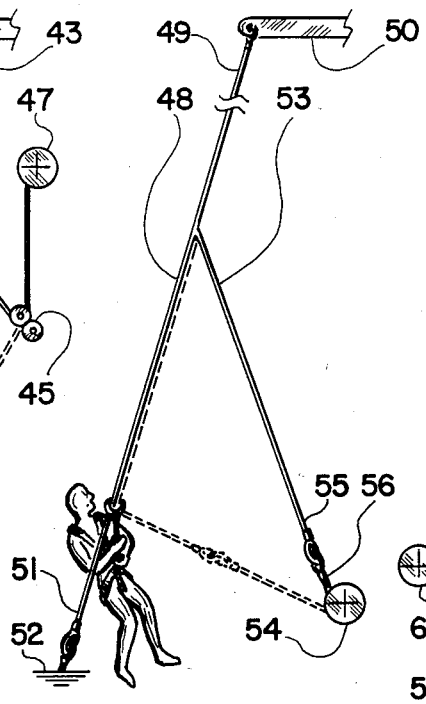
FIG. 6 illustrates still another embodiment of the sky-slide emergency escape system.

In FIG. 6 there is shown still another embodiment of the sky-slide emergency escape system comprising a guide wire rope 48 with its upper extremity 49 secured to an elevated structure 50 and its lower extremity 51 anchored to the lower level 52 in a taut state; and a braking wire rope 53 branching from the guide wire rope 48 and connected to the take-up wire rope reeled on a take-up reel system 54 including the same elements as those units 13 or 14 described in conjunction with FIG. 1. The wire rope shown in the broken lines illustrates the configuration of the braking wire rope 53 at an instant when the evacuee is about to land on the lower level 52. The lower extremity 51 of the guide wire rope 48 should be removably anchored to a hook or other anchoring means located in a street or parking lot adjacent to the elevated structure 50, which is located away from the elevated structure and concealed under the surface of the street or parking lot so that it does not interfere with the daily use of the street or parking lot. The take-up reel system 54 may be a mobile unit mounted on a fire truck or other rescue vehicle parked on the lower level 52 at a location some distance away from the elevated structure 50 whereby the person descending on the sky-slide system remains suspended under the guide wire rope 48 and the braking wire rope 53. The lower extremity 55 of the braking wire rope 53 is removably connected to the take-up wire rope 56 reeled on the take-up reel system 54 whereby the combination of the guide wire rope 48 and the braking wire rope 53 is stowed away to a storage position in the side of the elevated structure or at the top of the elevated structure after it is disconnected from the anchoring hook installed on the lower level and the mobile take-up reel system 54.

Figure 7:
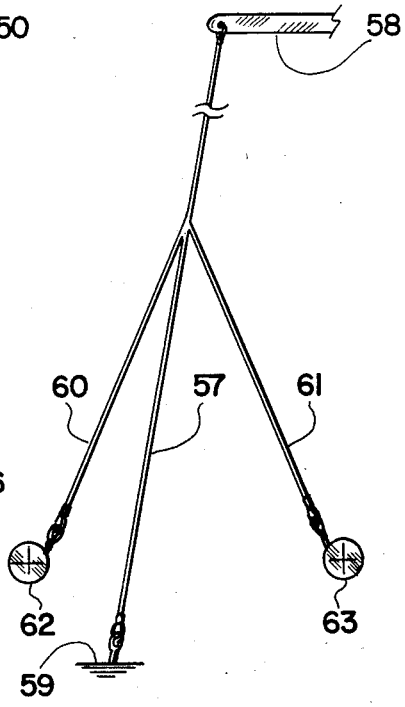
FIG. 7 illustrates still a further embodiment of the sky-slide emergency escape system.

In FIG. 7 there is shown still a further embodiment of the sky-slide emergency escape system arranged essentially in the same way as that of FIG. 6 with one exception being that the guide wire rope 57 stretched between the elevated structure 58 and the lower level 59 includes a pair of the braking wire ropes 60 and 61 branching therefrom and connected to the take-up wire ropes respectively reeled on the take-up reel systems 62 and 63, respectively, each of which have the same elements as that of the unit 13 or 14 described in conjunction with FIG. 1. It is readily understood that more than two braking wire ropes branching from the guide wire rope may be included wherein the lower extremities of the braking wire ropes are connected to the take-up reel system of matching numbers. It should be understood that, when there are more than two braking wire ropes included in the sky-slide system, it is important to include a guide wire rope stretched all the way between the elevated structure and the lower level as shown in FIG. 7 because the unequal braking between two take-up reel systems can cause the evacuee to slam onto one take-up reel system with a greater braking force. In general, those embodiments shown in FIGS. 6 and 7 are more desirable over the embodiment shown in FIG. 1.

Figure 8:
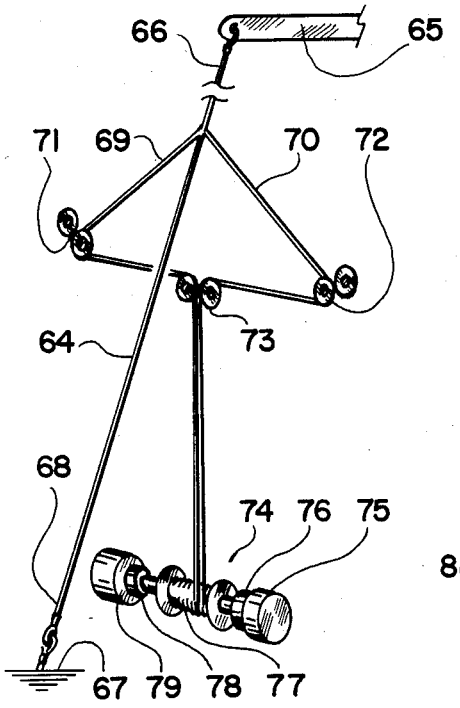
FIG. 8 illustrates yet another embodiment of the sky-slide emergency escape system.
Figure 9:
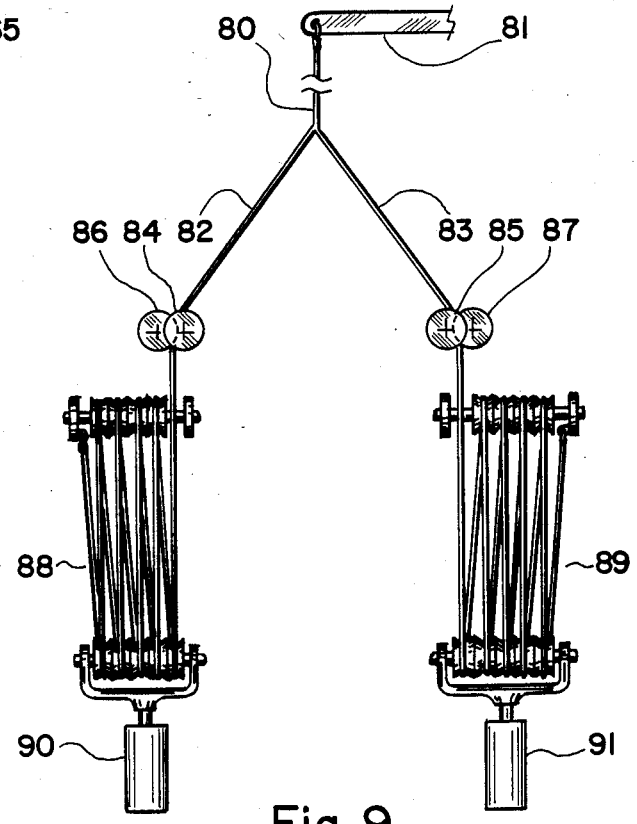
FIG. 9 illustrates yet a further embodiment of the sky-slide emergency escape system.

In FIG. 8 there is shown yet another embodiment of the sky-slide emergency escape system. The guide wire rope 64 is secured to an elevated structure 65 at the upper extremity 66 and removably anchored to the lower level 67 at the lower extremity 68. A pair of the braking wire ropes 69 and 70 branch off from the guide wire rope 64 at a junction intermediate the upper and lower extremities of the guide wire rope. The braking wire ropes 69 and 70 slidably engage and extend through the wire rope guides 71 and 72 disposed at two opposite sides of and at equal distances away from a vertical plane including the guide wire rope 64. The braking wire ropes 69 and 70 are routed side by side after passing through a third wire rope guide 73 and connected to a common take-up reel system comprising a one-way braking means including a brake 75 and a ratchet coupling 76; a take-up drum 77 and a friction clutch 78 frictionally linking the rotational movement between the power drive 79 and the take-up drum 77. The operational principle of the take-up reel system is the same as that of those units 13 and 14 described in conjunction with FIG. 1. The embodiment shown in FIG. 8 is suitable for a self-sufficient sky-slide system wherein the take-up reel system 74 is permanently installed inside the elevated structure and the anchoring hook removably anchoring the lower extremity 68 of the guide wire rope 64 is installed in the street or a parking lot in a concealed configuration. The guide wire rope 64 is stowed away to a storage position adjacent to the portion of the braking wire ropes 69 and 70 routed in a side by side relationship after the lower extermity 68 of the guide wire rope 64 is disconnected from the anchoring hook installed at the lower level. It should be understood that the lower extremities of the braking wire ropes 69 and 70 may be connected to two separate take-up reel systems in an arrangement similar to that of FIG. 4 or FIG. 5. It should be also understood that the lower extremities of the braking wire ropes may be connected to the take-up reel system powered by the earth's gravitational force as illustrated in FIG. 9. It should be mentioned that the embodiments shown in FIGS. 4 and 5 may be modified by extending the guide wire ropes all the way down to the lower level and removably anchoring them by the anchoring hooks installed at the lower level at a location some distance away from the elevated structure.

In FIG. 9 there is shown yet a further embodiment of the sky-slide emergency escape system comprising a guide wire rope 80 depending from an elevated structure 81 and a pair of the braking wire ropes 82 and 83 branching and extending from the guide wire rope 80. The braking wire ropes 82 and 83 are routed through the wire rope guides 84 and 85 equipped with one-way braking wheels 86 and 87, respectively, and connected to the compound pulley systems 88 and 99 powered by the weights 90 and 91, respectively. The one-way braking wheels 86 and 87 hinder the releasing movement of the braking ropes 82 and 83 from the compound pulley systems 88 and 89, while they do not interfere with the take-up movement of the braking wire ropes 82 and 83 into the compound pulley systems 88 and 89. The weights 90 and 91 are just heavy enough to power the compound pulley system to take up the braking wire ropes and to keep them at a taut state as shown in FIG. 9 when the braking wire ropes are not constrained by the clasp attached to the harness worn by a descending evacuee. The one-way braking wheels 86 and 84 gradually releases the braking wire ropes 82 and 83 that slows down the rapidly descending evacuee. When the evacuee removes the clasp attached to his harness from the braking wire ropes 82 and 83, the compound pulley systems 88 and 89 automatically pulls back the sky-slide to a taut state and it becomes ready to take the next evacuee. It is readily understood that the guide wire rope 80 may be extended all the way to the lower level and removably anchored to the lower level in the same manner as shown in FIG. 8. There are many other arrangements well known to the experts in the art which can be used as braking wire rope take-up systems including means for controlled release and rewinding of the braking wire ropes wherein mechanical, hydraulic or electromagnetic elements may be included to accomplish the objects of braking and rewinding. The sole purpose of the detailed construction of the braking wire ropes take-up systems included in the embodiments shown in FIGS. 1-9 is to demonstrate the objects and the feasibility of accomplishing such objects. It is quite obvious that the sky-slide system may be used as a device for training sky-divers and paratroopers.

While the principles of the present invention have now been made clear by the illustrative embodiments, there will be immediately obvious to the skilled in the art many modifications of the arrangements, elements, proportion, structures and materials particularly adapted to the specific working environment and operating conditions in the practice of the invention without departing from those principles.

We claim:

1. The sky-slide system for rapidly lowering a person or an object from an elevated structure to a lower level comprising in combination;

(a) a guide cord with one extremity secured to an elevated structure and the other extremity smoothly and securely connected to at least two braking cords respectively branching off from said other extremity of said guide cord whrein each of said braking cords reaches down to a lower level;

(b) a plurality of cord take-up means permanently or temporarily disposed immovably at a lower level away from each other and away from a vertical line including said one extremity of said guide cord secured to said elevated structure wherein each of said cord take-up means taking up each of said braking cords reaching down to a lower level includes a first means for taking up and tensing each of said braking cords and a second means for continuously releasing each of said braking cords at a controlled rate maintaining a controlled tension on each of said braking cords when said braking cords are pulled by a descending person or an object descending on said sky-slide system; and (c) a harness safely securing a descending person or an object on said sky-slide system, said harness depending from a ring including means for opening and closing said ring whereby said ring can be clasped on said guide cord;

whereby a person or an object wearing said harness to be lowered from said elevated structure clasps said ring supporting said harness onto said guide cord and jumps off from said elevated structure whereupon said descending person or object is first accelerated downward during a descent following said guide cord and then, decelerated gradually to a safe landing on a lower level by said braking cords being released from said cord take-up means at a controlled rate maintaining a controlled tension on said braking cords.

2. The combination as set forth in claim 1 wherein said first means included in each of said cord take-up means includes a cord take-up reel driven by a drive with a clutch and said second means included in said cord take-up means includes a braking means controlling the unreeling motion of said cord take-up reel.

3. The combination as set forth in claim 2 wherein said braking means is a one-way brake controlling the unreeling motion of said cord take-up reel while said braking means does not hinder the reeling motion of said cord take-up reel.

4. The combination as set forth in claim 3 wherein said clutch driving said cord take-up reel has a maximum torque large enough to reel up said braking cords when said braking cords are not pulled away from said cord take-up means by a descending person or object, while said maximum torque is low enough to release said braking cords when said braking cords are pulled away from said cord take-up means by a descending person or object;

whereby, said cord take-up means automatically reels up said braking cords to a taut state in the shape of a pyramid when said braking cords are not pulled by a descending person or object and automatically releases said braking cords at a controlled rate maintaining a tension on said braking cords when said braking cords are pulled by a descending person or object.

5. The combination as set forth in claim 1 wherein said first means included in each of said cord take-up means includes a cord take-up reel driven by a drive with a clutch constituting said second means included in said cord take-up means wherein the maximum torque of said clutch is large enough to reel up said braking cords when said braking cords are not pulled by a descending person or object, while said maximum torque of said clutch is small enough to release said braking cords and acts as a brake in releasing said braking cords at a controlled speed when said braking cords are pulled by a descending person or object.

6. The combination as set forth in claim 1 wherein said first means included in said cord take-up means includes a pulley system powered by a weight and said second means included in said cord take-up means includes a one-way brake hindering the releasing movement of said braking cords, while said one-way brake does not hinder the take-up movement of said braking cords caused by said weight powering said pulley system, wherein said weight is heavy enough to provide the take-up movement of said braking cords by said pulley system when said braking cords are not pulled by a descending person or object while said weight included in said pulley system is light enough to provide the releasing movement of the braking cords when said braking cords are pulled by a descending person or obobject.

7. The combination as set forth in claim 1 wherein each of said braking cords reaching down to a lower level is removably connected to each of said cord take-up means.

8. The combination as set forth in claim 1 wherein a plurality of guide means disposed away from each other and away from a vertical line including said one extremity of said guide rope secured to said elevated structure for slidably guiding said braking cords are included.

9. The combination as set forth in claim 8 wherein said guide means are disposed at a level intermediate said elevated structure and said cord take-up means.

10. The combination as set forth in claim 8 wherein said guide means are disposed at a level below said cord take-up means.

11. The sky-slide system for rapidly lowering a person or an object from an elevated structure to a lower level comprising in combination;

(a) a guide cord with one extremity secured to an elevated structure and the other extremity anchored to a lower level wherein said guide cord is in a substantially taut state;

(b) at least one braking cord branching from said guide cord intermediate said one extremity secured to said an elevated structure and said the other extremity anchored to said lower level and reaching down to a lower level;

(c) at least one cord take-up means permanently or temporarily disposed immovably at a lower level and disposed away from said the other extermity of said guide cord anchored to a lower level and away from a vertical line including said one extremity of said guide cord secured to said elevated structure wherein said cord take-up means taking up said braking cord reaching down to a lower level includes a first means for taking up and tensing said braking cord and a second means for continuously releasing said braking cord at a controlled rate maintaining a controlled tension on said braking cord when said braking cord is pulled by a descending person or object on said sky-slide system; and (d) a harness safely securing a descending person or object on sky-slide system, said harness depending from a ring including means for opening and closing said ring whereby said ring can be clasped on said guide cord;

whereby a person or an object wearing said harness to be lowered from said elevated structure clasps said ring supporting said harness onto said guide cord and jumps off from said elevated structure whereupon said descending person or object is first accelerated downward during a descent following said guide cord and, then, decelerated gradually to a safe landing on a lower level by said braking cord being released from said cord take-up means at a controlled rate maintaining a tension on said braking cord.

12. The combination as set forth in claim 11 wherein said first means included in said cord take-up means includes a cord take-up reel driven by a drive with a clutch and said second means included in said cord take-up means includes a braking means controlling the unreeling motion of said cord take-up reel.

13. The combination as set forth in claim 12 wherein said braking means is a one-way brake controlling the unreeling motion of said cord take-up reel while said braking means does not hinder the reeling motion of said cord take-up reel.

14. The combination as set forth in claim 13 wherein said clutch driving said cord take-up reel has a maximum torque large enough to reel up said braking cord when said braking cord is not pulled by a descending person or object, while said maximum torque is low enough to release said braking cord when said braking cord is pulled by a descending person or object; whereby said cord take-up means automatically reels up said braking cord to a taut state wherein said guide cord and said braking cord are disposed in the shape of a pyramid when said braking cord is not pulled by a descending person or object and automatically releases said braking cord at a controlled rate maintaining a tension on said braking cord when said braking cord is pulled by a descending person or object.

15. The combination as set forth in claim 11 wherein said first means included in said cord take-up means includes a cord take-up reel driven by a drive with a clutch constituting said second means included in said cord take-up means, wherein the maximum torque of said clutch is large enough to reel up said braking cord when said braking cord is not pulled by a descending person or object while said maximum torque of said clutch is small enough to release said braking cords and acts as a brake in releasing said braking cord at a controlled speed when said braking cord is pulled by a descending person or object.

16. The combination as set forth in claim 11 wherein said first means included in said cord take-up means includes a pulley system powered by a weight and said second means included in said cord take-up means includes a one-way brake hindering the releasing movement of said braking cord, while said one-way brake does not hinder the take-up movement of said braking cord caused by said weight powering said pulley system, wherein said weight is heavy enough to provide the take-up movement of said braking cord by said pulley system when said braking cord is not pulled by a descending person or object while said weight included in said pulley system is light enough to provide the releasing movement of said braking cord when said braking cord is pulled by a descending person or object.

17. The combination as set forth in claim 11 wherein said braking cord reaching down to a lower level is removably connected to said cord take-up means and said guide cord is removably anchored to said lower level.

18. The combination as set forth in claim 11 wherein at least one guide means disposed away from said guide cord in a taut state and away from a vertical line including said one extremity of said guide cord secured to said elevated structure for slidably guiding said braking cord is included.

19. The combination as set forth in claim 18 wherein said guide means is disposed at a level intermediate said elevated structure and said cord take-up means.

20. The combination as set forth in claim 18 wherein said guide means is disposed at a level below said cord take-up means.

21. A sky-slide system for rapidly lowering a person or object from an elevated structure comprising in combination:

(a) a sky-slide cord assembly comprising a guide cord including a first means for securing one extremity of said guide cord to an elevated structure and a second means for removably anchoring the other extremity of said guide cord to a lower level in a substantially taut state, said guide cord further including at least one braking cord branching off from said guide cord intermediate said one extremity and said the other extremity of said guide cord wherein said braking cord comprising a means for removably connecting the extremity of said braking cord reaching down to a lower level to a cord take-up means including a first means for taking up and tensing said braking cord when said braking cord is not pulled by a descending person or object and a second means for braking the releasing motion of said braking cord from said cord take-up means at a controlled speed when said braking cord is pulled by a descending person or object; and (b) a harness safely securing a person or an object, said harness depending from a ring including means for opening and closing said ring whereby said ring can be clasped onto said guide cord;

whereby a person or an object wearing said harness to be lowered from said elevated structure clasps said ring supporting said harness onto said guide cord and jumps off from said elevated structure whereupon said descending person or object is first accelerated downward during a descent following an upper portion of said guide cord and, then, is decelerated gradually to a safe landing on a lower level by said braking cord being released from said cord take-up means at a controlled rate maintaining a tension on said braking cord.

* * * * *